US005994016A

United States Patent [19]

Kuramoto et al.

[11] Patent Number: 5,994,016

[45] Date of Patent: Nov. 30, 1999

[54] DRY DEVELOPER FOR DEVELOPING ELECTROSTATIC LATENT IMAGE

[75] Inventors: Shinichi Kuramoto; Mitsuo Aoki, both of Numazu; Masakazu Yashiro, Suntoh-gun; Akira Oyamaguchi; Hiroshi Sugimoto, both of Numazu, all of Japan

[73] Assignee: Ricoh Company, Ltd., Tokyo, Japan

[21] Appl. No.: 09/085,715

[22] Filed: May 28, 1998

[30] Foreign Application Priority Data

May 28, 1997 [JP] Japan ..... 9-153135
May 25, 1998 [JP] Japan ..... 10-158666

[51] Int. Cl.[6] ..... G03G 9/097

[52] U.S. Cl. ..... 430/110; 430/111; 430/137

[58] Field of Search ..... 430/106, 110, 430/111, 137

[56] References Cited

U.S. PATENT DOCUMENTS

| | | | |
|---|---|---|---|
| 4,562,136 | 12/1985 | Inoue et al. | 430/107 |
| 4,590,141 | 5/1986 | Aoki et al. | 430/108 |
| 4,908,290 | 3/1990 | Watanabe et al. | 430/106.6 |
| 4,933,250 | 6/1990 | Nakayama et al. | 430/106 |
| 4,956,258 | 9/1990 | Watanabe et al. | 430/109 |
| 4,980,258 | 12/1990 | Aoki et al. | 430/110 |
| 5,061,588 | 10/1991 | Fushimi et al. | 430/109 |
| 5,370,959 | 12/1994 | Hagiwara et al. | 430/120 |
| 5,380,616 | 1/1995 | Aoki et al. | 430/110 |
| 5,403,690 | 4/1995 | Kuramoto et al. | 430/110 |
| 5,554,478 | 9/1996 | Kuramoto et al. | 430/110 |
| 5,759,731 | 6/1998 | Hagi et al. | 430/110 |
| 5,776,647 | 7/1998 | Kido et al. | 430/110 |

*Primary Examiner*—John Goodrow
*Attorney, Agent, or Firm*—Oblon, Spivak, McClelland, Maier & Neustadt, P.C.

[57] ABSTRACT

A color developer is described that contains a toner and a resin-coated carrier, wherein the toner contains a hydrophobic particulate titania and a charge controlling agent, and the charge controlling agent contains an aromatic hydroxycarboxylic acid metal salt having the following formula (1):

(1)

wherein each of Q and Q' each independently represents a residual group of an aromatic hydroxycarboxylic acid optionally substituted with an alkyl group, an aralkyl group, or an alkyl group and an aralkyl group; X is a counter ion; and M is a metal. A toner is also provided that contains the above charge controlling agent.

18 Claims, No Drawings

DRY DEVELOPER FOR DEVELOPING ELECTROSTATIC LATENT IMAGE

BACKGROUND OF THE INVENTION

1. Field of the Invention

The present invention relates to a dry developer for developing an electrostatic latent image formed by electrophotography, electrostatic recording, electrostatic printing or the like.

2. Discussion of the Background

Two-component dry developers that include a mixture of a toner and a carrier are well known. In a two-component dry developer, toner particles having a relatively small particle size are retained on the surface of carrier particles having a relatively large particle size by an electric force caused by friction between the toner particles and the carrier particles. When the dry developer approaches an electrostatic latent image, and the force which is caused by an electric field formed by the latent image becomes greater than the binding force between the toner particles and the carrier particles, the toner particles are attracted to the latent image, resulting in visualization of the latent image. The developer may therefore last a long time, requiring only the addition of toner commensurate with the amount of the toner spent for developing latent images.

In a two-component dry developer, metal oxides such as magnetite, ferrite and the like are typically employed as a carrier material. These metal oxides have a relatively small bulk density compared to an iron powder. The metal oxide carriers have the following advantages:

(1) a lightweight dry developer can be obtained by using one of the metal oxide carriers;

(2) a dry developer including one of the metal oxide carriers can be easily agitated in a developing unit because the developer is lightweight;

(3) the metal oxide carriers can maintain good magnetic properties such as low remanent magnetic flux density, low coercive force and a small area hysteresis loop regardless of its magnetization history; and (4) the metal oxide carriers are chemically stable and are relatively unaffected by chemicals such as ozone, nitrogen oxides ($NO_x$) and the like, which tend to be formed in copying machines.

However, even the aforementioned metal oxide carriers have drawbacks in that when a developer containing a toner and the metal oxide carrier is used for a high speed copying machine in which the developer is rotated at a high speed, "a spent-toner problem" occurs in which the toner melted by heat caused by collisions between particles of the developer or between particles of the developer and the developing unit forms a film on the surface of the carrier particles. When this spent-toner problem occurs, the charging ability of the carrier deteriorates, resulting in toner scattering and background fouling of formed images.

To solve the spent-toner problem, developers having a resin-coated carrier have been disclosed. However, a good developer which avoids the spent-toner problem has not yet been obtained. For example, a carrier coated with a resin such as a styrene-methacrylate copolymer or a styrene polymer has good charging properties, but the critical surface tension of the surface of the resin-coated carrier is relatively high, which results in the spent-toner problem when the carrier is used for a long time. Therefore, the resin-coated carrier has a short life.

Toners include a charge controlling agent. Metal salts of monoazo dyes, nitrohumic acid and its salts, sulfonated copper phthalocyanine pigments, styrene oligomers having a nitro group or a halogen atom, chlorinated paraffin, melamine resins and the like are typically employed as negative charge controlling agents. These materials have a drawback in that they cannot be reliably manufactured because of their complex chemical structure. In addition, these charge controlling agents tend to decompose or undergo a change in quality when the toner containing these charge controlling agents is kneaded, resulting in deterioration of charge controlling ability of the resulting toner. Another drawback is that the charge controlling ability of the charge controlling agents can change depending on environmental conditions. Furthermore, if a toner that includes these charge controlling agents is used for a long time, the charging ability of the toner deteriorates, and a toner film is formed on a photoconductor, resulting in the deterioration of image quality.

Japanese Laid-Open Patent Publication No. 61-223753 discloses a toner that includes an aromatic hydroxycarboxylic acid metal salt such as a chrome complex of salicylic acid as a charge controlling agent. This toner has a drawback in that the charge of the toner varies substantially when environmental conditions are changed or if the toner is used for a long time.

Japanese Laid-Open Patent Publication No. 3-1162 discloses a toner that includes a fluorinated ammonium compound or a fluorinated iminium compound as the charge controlling agent. This toner has a drawback in that its charge is not stable when used together with a non-resin coated carrier. However, even though the toner is used with a carrier that is coated with a styrene-acrylate copolymer, the charge of the toner is seriously changed when the developer is used repeatedly even though being supplied with new toner. In addition, the toner has a poor charge rising property.

Japanese Laid-Open Patent Publication No. 6-337458 discloses a toner that includes a combination of a fluorinated ammonium compound or a fluorinated iminium compound and an aromatic hydroxycarboxylic acid metal salt as a charge controlling agent. This toner has a drawback in that the charge of the toner is not stable when used for a small developing unit, which is necessary for color image forming apparatuses wherein the toner receives a relatively heavy load per unit volume.

Because of these reasons, a need exists for a dry developer that can produce good quality images for a long time and maintain uniform charge properties even when used in a small developing unit.

SUMMARY OF THE INVENTION

Accordingly, an object of the present invention is to provide a dry developer that can produce good quality images having good color reproducibility for a long time even when used in a small size developing unit in color image forming apparatuses.

Another object of the present invention is to provide a dry developer that has good charge properties without generating toner scattering during long-term continuous use.

Another object of the present invention is to provide a dry developer that can produce good quality images independent of environmental conditions.

These and other objects of the present invention have been attained by a color developer, that includes a toner and a resin-coated carrier, wherein the toner includes a hydrophobic particulate titania and a charge controlling agent, and the charge controlling agent includes an aromatic hydroxycarboxylic acid metal salt having the following formula (1):

(1)

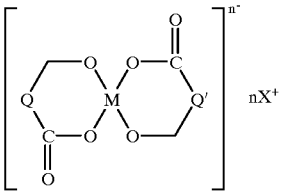

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

Accordingly, the first embodiment of the present invention relates to a color developer that includes:

a toner and a resin-coated carrier, wherein the toner contains a hydrophobic particulate titania and a charge controlling agent;

wherein the charge controlling agent includes an aromatic hydroxycarboxylic acid metal salt having the following formula (1):

(1)

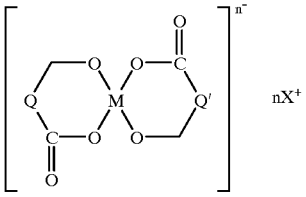

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

The second embodiment of the present invention relates to a method for preparing a color developer that includes:

mixing a toner and a resin-coated carrier, wherein the toner contains a hydrophobic particulate titania and a charge controlling agent;

wherein the charge controlling agent includes an aromatic hydroxycarboxylic acid metal salt having the following formula (1):

(1)

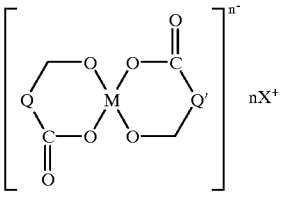

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

The third embodiment of the present invention relates to a toner that includes:

a charge controlling agent that includes an aromatic hydroxycarboxylic acid metal salt having the following formula (1):

(1)

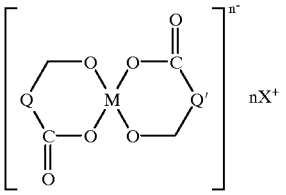

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

DESCRIPTION OF THE PREFERRED EMBODIMENTS

Other features of the present invention will become apparent in the course of the following description of the preferred embodiments, which is not intended to be limiting.

Preferably, the toner further includes a particulate silica, which is subjected to a hydrophobic treatment, in a weight ratio of from about 1/9 to about 6/4 to the particulate titania. Preferably, the total content of the particulate titania and silica in the toner is from about 0.1 to about 2.0 parts by weight per 100 parts by weight of the toner.

The aromatic hydroxycarboxylic acid metal salt preferably includes a zinc salt of a salicylic acid derivative.

The resin coated on the carrier preferably includes a silicone resin or a fluorine-contained acrylic resin.

Preferably, the dry developer of the present invention includes a toner including a binder resin, a coloring agent and a charge controlling agent, and a resin coated carrier, wherein the toner further includes a particulate titania which is subjected to a hydrophobic treatment, and wherein the charge controlling agent includes a metal salt of an aromatic hydroxycarboxylic acid having the following formula (1):

(1)

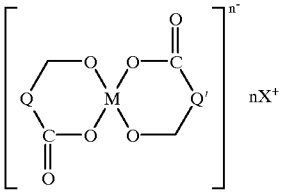

wherein Q and Q' independently represent a residual group of an aromatic hydroxycarboxylic acid which may be substituted with an alkyl group and/or an aralkyl group; X represents a counter ion; and M represents a metal element.

The aromatic hydroxycarboxylic acid metal salts of formula (1) are colorless and transparent; and the resultant toner has good transparency, and good full color images can be reproduced. In addition, these aromatic hydroxycarboxylic acid metal salts have good charge controlling ability, and the resultant toner has good charging properties.

Suitable hydroxycarboxylic acid compounds which may be substituted with an alkyl group and/or an aralkyl group for use in the hydroxycarboxylic acid metal salts include salicylic acid, alkyl (C1–C12)-salicylic acid, 3, 5-dialkyl (C1–C12) salicylic acid, 1-hydroxy-2-naphthoic acid, 2-hydroxy-3-naphthoic acid, 2-hydroxy-1-naphthoic acid, alkyl (C3–C12) 2-hydroxy-3-naphthoic acid, 6-(α-methylbenzyl)-2-hydroxy-3-naphthoic acid and the like.

Suitable metals for use in the hydroxycarboxylic acid metal salts include Zn, Cr, Co, Al and the like. The hydroxycarboxylic acid metal salts have a counter ion depending on the valence of the metal. The counter ion can be changed by changing the conditions of a treatment performed after the production of the hydroxycarboxylic acid metal salts. For example, when the pH of a product which includes a hydroxycarboxylic acid metal salt and which is not filtered is 3 or less and the product is then washed with water so that the pH of the product is from about 6 to about 7, the counter ion of the hydroxycarboxylic acid metal salt is a hydrogen ion. In this case, when the product is washed with water including an alkaline compound so that the pH of the product is 7 or greater, the counter ion is an alkaline ion. In addition, when the product is washed with water including an ammonium chloride compound, the counter ion is an ammonium ion.

Specific examples of such metal salts of hydroxycarboxylic acid include the compounds shown in Table 1.

TABLE 1

1.

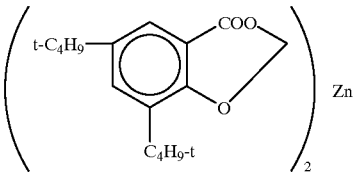

2.

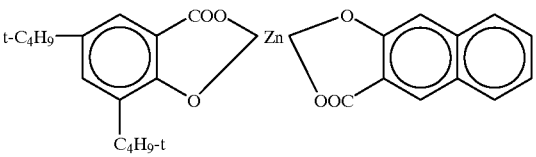

3.

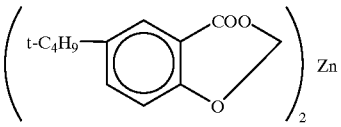

4.

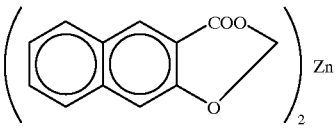

5.

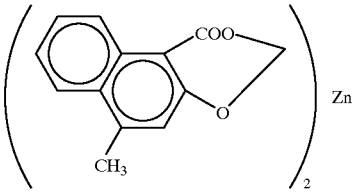

6.

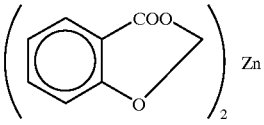

7.

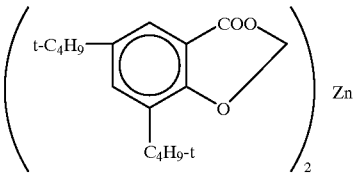

TABLE 1-continued
8.
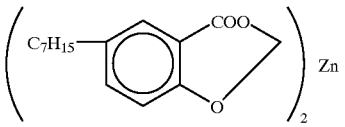
9.
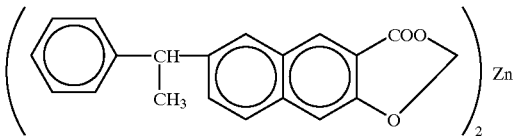
10.
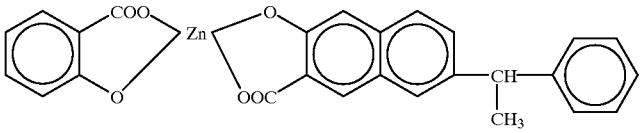
11.
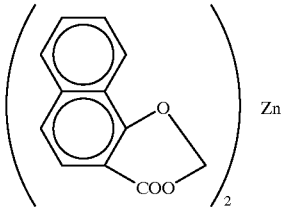
12.
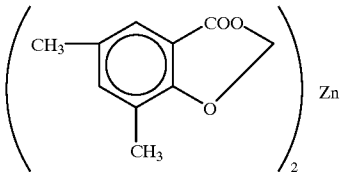
13.
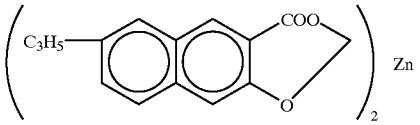
14.
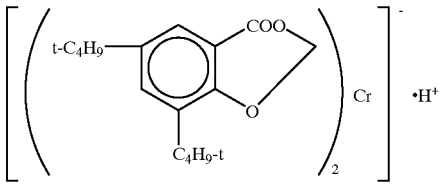
15.
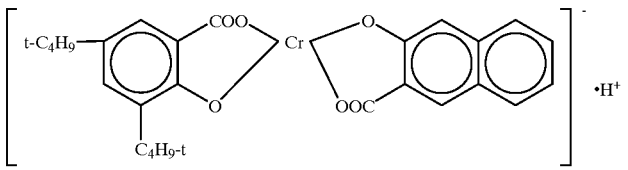
16.
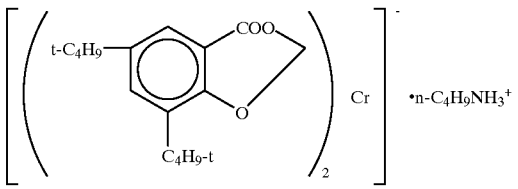

TABLE 1-continued
17.
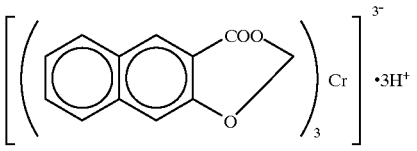
18.
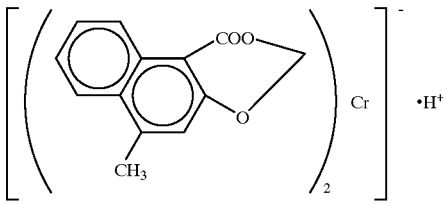
19.
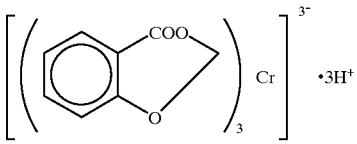
20.
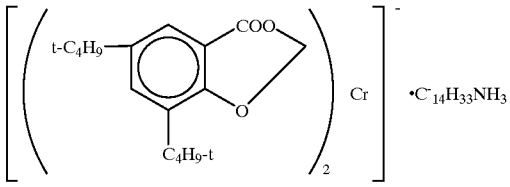
21.
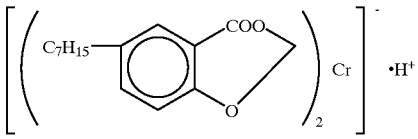
22.
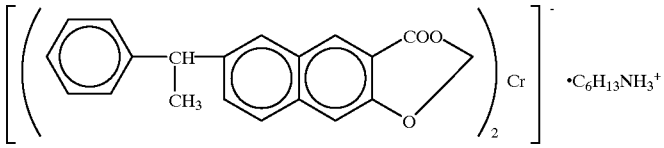
23.
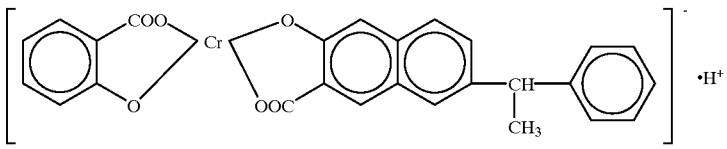
24.
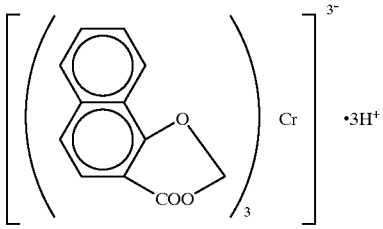

TABLE 1-continued
25.
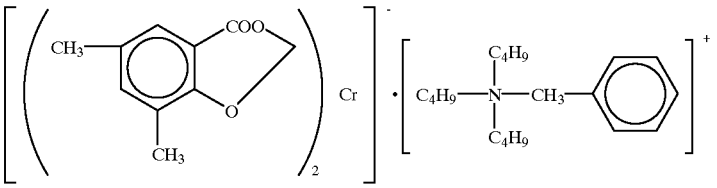
26.
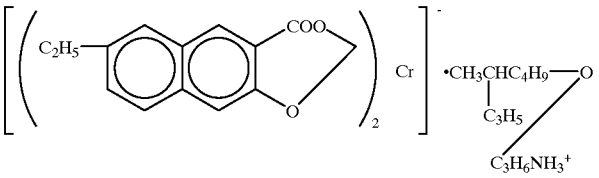
27.
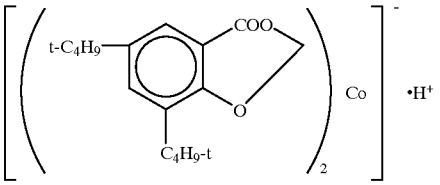
28.
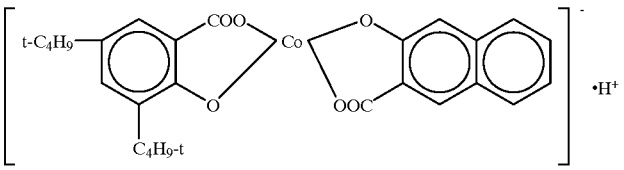
29.
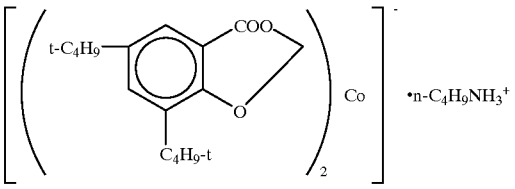
30.
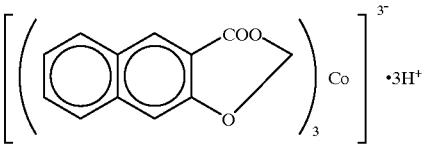
31.
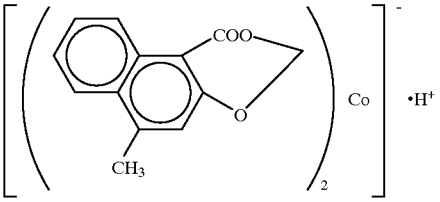
32.
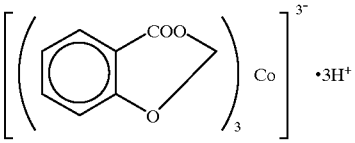

TABLE 1-continued
33.
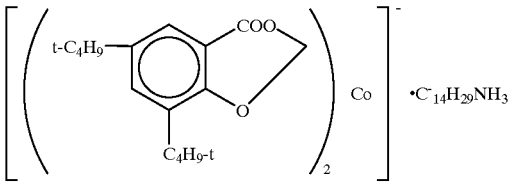
34.
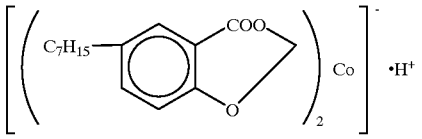
35.
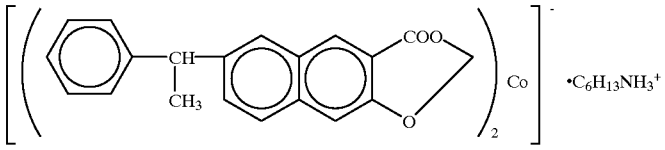
36.
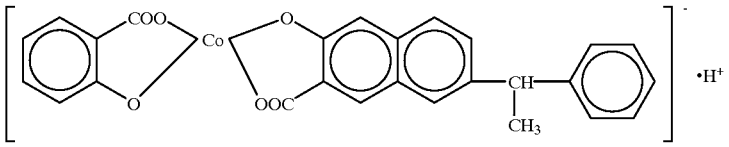
37.
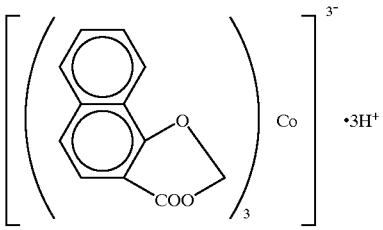
38.
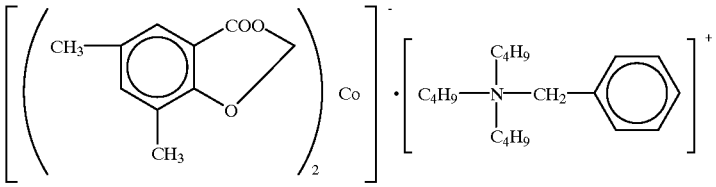
39.
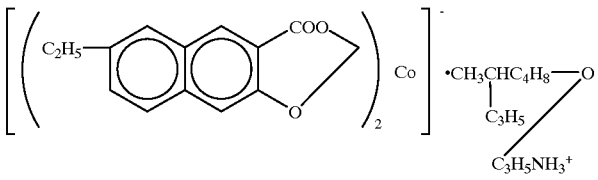
40.
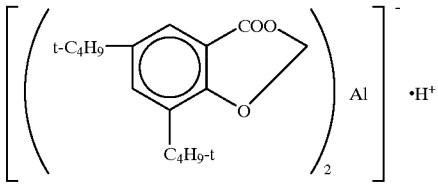

TABLE 1-continued
41.
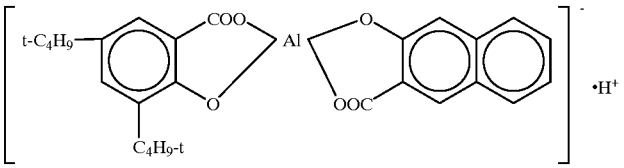
42.
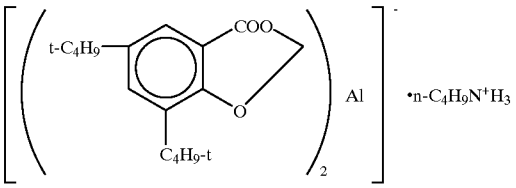
43.
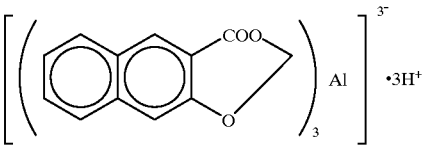
44.
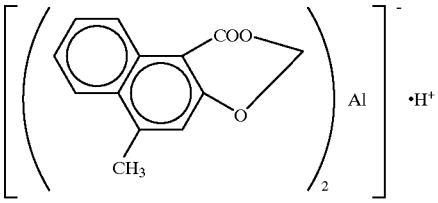
45.
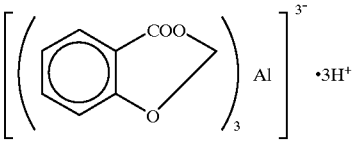
46.
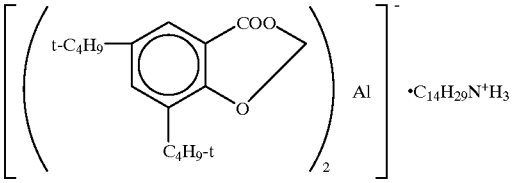
47.
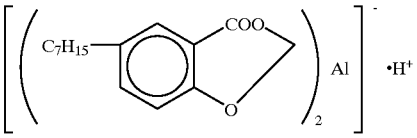
48.
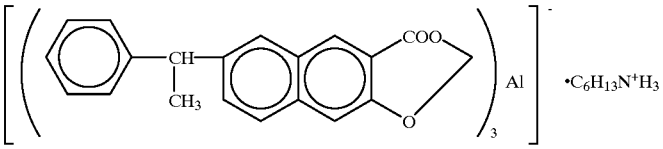

TABLE 1-continued

49.

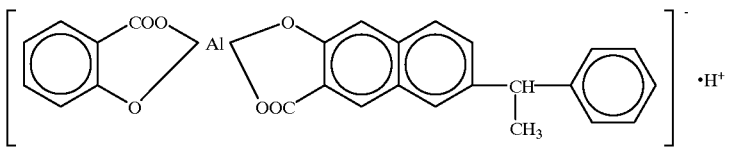

50.

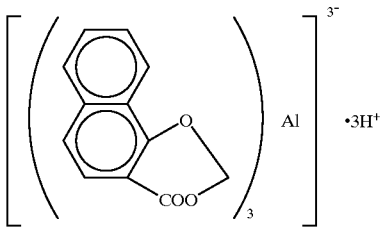

51.

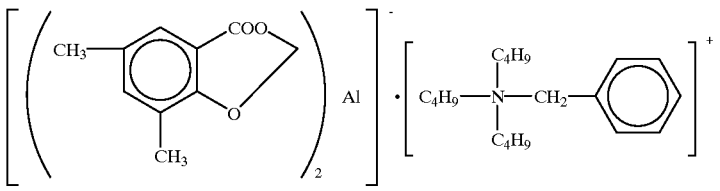

52.

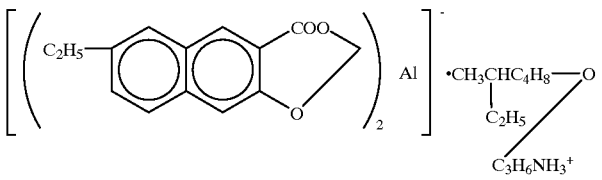

Among the aforementioned compounds, hydroxycarboxylic acid zinc salts are particularly preferable for a color toner because they are colorless and the resultant toner can keep good charge properties.

In addition, particulate silica, titania and alumina which are subjected to a hydrophobic treatment can be added to the toner of the present invention.

Specific examples of such particulate silica for use in the toner of the present invention include HDK H 2000, HDK H 2000/4, HDK H 2050EP and HVK21, each of which is manufactured by Hoechst AG, and R972, R974, RX200, RY200, R202, R805 and R812, each of which is manufactured by Nippon Aerosil Co., and TS720 which is manufactured by Cabot Corp. Specific examples of the particulate titania include P-25 (manufactured by Nippon Aerosil Co.), and STT-30, STT-65C-S (manufactured by Fuji Titan Industry Co., Ltd.), and MT-15OW, MT-500B and MT-600B (manufactured by Tayca Corp.). Suitable particulate titania for use in the toner of the present invention includes titanium dioxides, $TiO_2$, which have a crystal structure such as anatase-type structure or rutile-type structure, or a noncrystal structure and which are subjected to a hydrophobic treatment. Specific examples of such titanium dioxides include T-805 (manufactured by Nippon Aerosil Co.), and hydrophobic rutile-type titanium dioxide such as MT-100S and MT-100T (manufactured by Tayca Corp.), and STT-30A and STT-65S-S (manufactured by Titan Kogyo K.K.), and TAF-500T and TAF-1500T (manufactured by Fuji Titan Industry Co., Ltd.), and IT-S (manufactured by Ishihara Sangyo Kaisha Ltd.).

Particulate hydrophobic silica, titania and alumina can be obtained by treating silica, titania and alumina particles, which are hydrophilic, with a silane coupling agent such as methyltrimethoxysilane, methyltriethoxysilane, octyltrimethoxysilane or the like. In addition, these hydrophobic particles can be obtained by subjecting these hydrophilic particles to polycyclohexane treatment.

The toner of the present invention may include additives such as a fatty acid metal salt (zinc stearate or aluminum stearate), a metal oxide (alumina, tin oxide or antimony oxide), a fluoro polymer and the like in combination with the hydrophobic silica, titania or alumina.

In the toner of the present invention, when particulate titania and silica each of which is subjected to a hydrophobic treatment is included in a toner in a mixing ratio of from about 1/9 to about 6/4 and preferably from about 1/9 to about 5/5, the resultant toner can keep good fluidity and good charge rising properties even when used for a long time. In addition, the total content of the titania and the silica is preferably from about 0.1 to about 2.0 parts by weight, more preferably 0.2 to 1.0 parts by weight per 100 parts by weight of the toner to obtain a good toner capable of producing images having good image qualities without fouling in background of images. All the above ranges include all values and subranges therebetween.

Suitable binder resins for use in the toner of the present invention include known resins which are used for conventional toners.

Specific examples of such binder resins include homopolymers of styrene and substituted styrene such as polystyrene, polychlorostyrene and polyvinyl toluene; styrene copolymers such as styrene/p-chlorostyrene copolymers, styrene/propylene copolymers, styrene/vinyl toluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/methyl α-chloromethacrylate copolymers, styrene/acrylonitrile copolymers, styrene/vinyl ethyl ether copolymers, styrene/vinyl methyl ketone copolymers, styrene/butadiene copolymers, styrene/isoprene copolymers, styrene/acrylonitrile/indene copolymers, styrene/maleic acid copolymers and styrene/maleate copolymers; polymethyl methacrylate; polymethyl methacrylate; polyvinyl chloride; polyvinyl acetate; polyethylene; polypropylene; polyester; polyvinyl butyral; polyacrylates; rosins; modified rosins; terpene resins; phenolic resins; aliphatic or alicyclic resins; aromatic petroleum resins; chlorinated paraffin; paraffin waxes; and the like. These resins are used alone or in combination.

Suitable coloring agents for use in the toner of the present invention include known dyes and pigments which are used for conventional toners.

Specific examples of such dyes and pigments include carbon black, Nigrosine dyes, iron black, Naphthol Yellow S, Hansa Yellow (10G, 5G and G), cadmium yellow, yellow colored iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow NCG)-, Vulcan Fast Yellow (5G and R), Tartrazine Yellow Lake, Quinoline Yellow Lake, Anthracene Yellow BGL, isoindolinone yellow, red iron oxide, red lead, orange lead, cadmium red, cadmium mercury red, antimony orange, Permanet Red 4R, Para Red, Fire Red, p-chloro-o-nitro aniline red, Lithol Fast Scarlet G, Brilliant Fast Scarlet, Brilliant Carmine BS, Permanent Red (F2R, F4R, FRL, FRLL and F4RH), Fast Scarlet VD, Vulkan Fast Rubine B, Brilliant Scarlet G, Lithol Rubine GX Permanent F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizarine Lake, Thioindigo red B, Thioindigo Maroon, Oil Red, quinacridone red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue lake, metal-free Phthalocyanine Blue, Phthalocyanine Blue, Fast Sky Blue, Indanthrene Blue (RS, BC), indigo, ultramarine, prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and the like. These dyes and pigments are employed alone or in combination. The content of a coloring agent in the toner of the present invention is preferably from about 0.1 to about 50 parts by weight more preferably 0.5 to 30 parts by weight per 100 parts by weight of the binder resin. These ranges include all values and subranges therebetween.

A suitable carrier material for use in the developer of the present invention includes known materials, e.g., ferromagnetic metals such as iron, cobalt, nickel and the like; metal oxides such as magnetite, hematite, ferrite and the like; glass beads; and the like. A suitable average particle size of these materials is from about 10 to about 1000 μm, and preferably about 30 to about 500 μm. These ranges include all values and subranged therebetween. These materials are preferably coated with a resin. Suitable resins useful for coating the carrier include polyfluorocarbon, polyvinyl chloride resins, polyvinylidene chloride resins, phenolic resins, polyvinyl acetal resins, silicone resins, fluorine-containing resins and the like. Among these resins, silicone resins and fluorine-containing acrylic resins are preferable because they can keep a good charging ability and thereby the resultant resin-coated carrier has a long life.

Specific examples of such silicone resins include known silicone resins such as KR261, KR271, KR272, KR275, KR280, KR282, KR285, KR251, KR155, KR220, KR201, KR204, KR205, KR206, SA4, ES1001, ES1001N, ES1002T and KR3093 which are manufactured by Shin-Etsu Chemical Co., Ltd., and SR2100, SR2101, SR2107, SR2110, SR2108, SR2109, SR2115, SR2400, SR2410, SR2411, SH805, SH806 and SH840 which are manufactured by Dow Corning-Toray Silicone Co., Ltd.

Suitable fluorine-containing acrylic resins useful as a coating resin include fluorinated allyl acrylate copolymers, fluorinated alkyl methacrylate copolymers and the like. Specific examples of such fluorine-contained acrylic resins are shown in Table 2.

TABLE 2

1

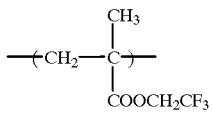

2

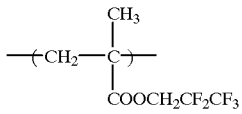

3

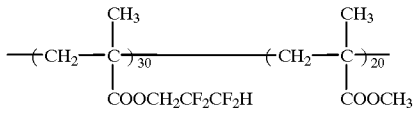

4

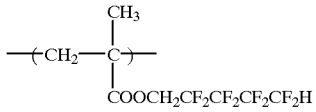

5

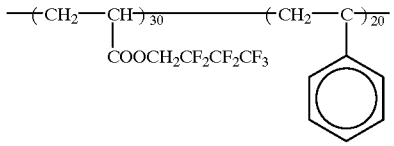

6

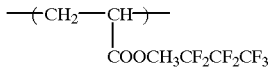

7

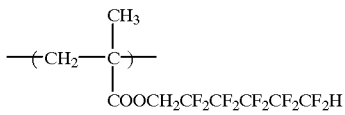

TABLE 2-continued

| | |
|---|---|
| 8 | $-(CH_2-C(CH_3)(COOCH_3CF_3CF_3))_{30}-(CH_2-C(CH_3)(COOCH_3))_{20}-$ |
| 9 | $-(CH_2-C(CH_3)(COOCH_2(CF_3)_2H))-$ |
| 10 | $-(CH_2-CH(COOCH_2(CF_2)_4H))_{35}-(CH_2-C(CH_3)(COOCH_3))_{45}-$ |
| 11 | $-(CH_2-C(CH_3)(COO(CH_3)_2(CF_2)_3H))-$ |
| 12 | $-(CH_2-CH(COOCH_2(CF_2)_2H))_{40}-(CH_2-C(C_6H_5))_{10}-$ |
| 13 | $-(CH_2-CH(COOCH_3(CF_2)_4H))_{10}-(CH_3-C(CH_3)(COOCH_3))_{15}-$ |
| 14 | $-(CH_2-C(CH_3)(COOCH_2(CF_2)_3H))_{75}-(CH_2-C(CH_3)(COOCH_3))_{25}-$ |
| 15 | $-(CH_2-CH(COOCH_3CF_3))-$ |
| 16 | $-(CH_2-C(CH_3)(COOCH_2CF_2))_{20}-(CH_2-C(CH_3)(COOCH_3))_{50}-$ |
| 17 | $-(CH_2-C(CH_3)(COOCH_2CF_3))_{30}-(CH_2-CH(COOCH_3))_{10}-$ |
| 18 | $-(CH_2-CH(COOCH_2CF_2CF_3))-$ |
| 19 | $-(CH_2-C(CH_3)(COOCH_2CF_3))_{55}-(CH_2-C(CH_3)(COOCH_3))_{45}-$ |

TABLE 2-continued

| | |
|---|---|
| 20 | $-(CH_2-C(CH_3)(COOCH_2(CF_2)_2CF_3))-$ |
| 21 | $-(CH_2-C(CH_3)(COOCH_2(CF_2)_4CF_3))-$ |
| 22 | $-(CH_2-C(CH_3)(COOCH_2(CF_2)_{10}CF_3))-$ |
| 23 | $-(CH_2-C(CH_3)(COOCH_2CF_3))_{45}-(CH_2-C(CH_3)(COOCH_3))_{55}-$ |
| 24 | $-(CH_2-CH(COOCH_2(CF_2)_{10}CF_3))_{50}-(CH_2-C(CH_3)(COOCH_3))_{20}-$ |

The aforementioned resins are preferably coated on the carrier particles by a spray coating method, a dip coating method or the like.

The ratio of the resin to the carrier in the coated carrier of the present invention is preferably from about 0.1/100 to about 10/100 by weight, and more preferably from about 1/100 to about 5/100 by weight. These ranges include all values and subranges therebetween.

The resin-coated carrier of the present invention may include an electroconductive fine powder in the resin layer to decrease the resistance of the resin-coated carrier, resulting in the prevention of "an edge-effect problem" in which an image density of an edge part of a solid image is darker than that of the center part of the solid image.

The electroconductive powder preferably has a particle diameter of from about 0.14 to about 5.0 $\mu$m, more preferably from about 0.2 $\mu$m to about 4.0 $\mu$m. The content of the electroconductive powder in the resin layer of the carrier is from about 0.01 to about 30 parts by weight, and preferably from about 0.1 to about 20 parts by weight, per 100 parts by weight of the coating resin. These ranges include all values and subranges therebetween. Specific examples of such electroconductive powder include known electroconductive materials. Among these materials, carbon black such as contact black, furnace black, thermal black and the like are preferable.

The carrier of the present invention may include a coupling agent to keep a good positive chargeablity and to promote the dispersion of the electroconductive fine powder in the resin layer. In this case, a coating liquid useful for coating of the carrier can be prepared, for example, by adding a coupling agent and an electroconductive powder to a resin solution and dispersing the mixture by a mixer.

Suitable coupling agents for use in the resin layer of the resin coated carrier of the present invention include compounds having the following formula:

$$X—Si(OR)_3$$

wherein X represents a functional group which reacts with an organic material and R represents a group which can be hydrolyzed. Among these compounds, silane coupling agents having an amino group, i.e., amino silane coupling agents, are preferable because the electroconductive material can be uniformly and stably dispersed in the coating resin of the coated carrier.

Specific examples of such amino silane coupling agents include γ-(2-aminoethyl)aminopropyltrimethoxy silane, γ-(2-aminoethyl)aminopropylmethyldimethoxy silane, γ-aminopropyltrimethoxy silane, octadecyldimethyl{3-(trimethoxysilyl)propyl)ammonium chloride and the like. The content of the coupling agent in the coated resin layer is from about 0.1 to about 10 parts by weight, and preferably from about 0.2 to about 5 parts by weight per 100 parts by weight of the coating resin. These ranges include all values and subranges therebetween.

The mixing ratio of the toner and the carrier about of the present invention is about 0.5/100 to about 6.0/100 by weight, more preferably about 1.0/100 to about 5.0/100 by weight. These ranges include all values and subranges therebetween.

EXAMPLES

Having generally described this invention, fiuther understanding can be obtained by reference to certain specific examples which are provided herein for the purpose of illustration only and are not intended to be limiting. In the descriptions in the following examples, the numbers represent weight ratios in parts, unless otherwise specified.

Toner Manufacturing Example 1

Black Toner

The following components were mixed and agitated with a flusher.

| | |
|---|---|
| Water | 1200 |
| Phthalocyanine Green hydrous cake (solid content of 30%) | 200 |
| Carbon black | 540 |

The mixture was then mixed with 1200 parts of an epoxy polyol resin (Mn: 3750, Mw/Mn: 4.2 and Tg: 59° C.) and kneaded at 150° C. for 30 minutes. The kneaded mixture was mixed with 1000 parts of xylene and further kneaded for 1 hour. After the water and the xylene were removed from the mixture, the mixture was pulverized with a pulverizer to obtain a black toner master batch.

The following components were mixed with a mixer, and then melted and kneaded with a two-roller mill.

| | |
|---|---|
| Epoxy polyol resin (Mn: 3750, Mw/Mn: 4.2 and Tg: 59° C.) | 100 |
| Black toner master batch | 8 |
| Zinc salicylate derivative | 2 |

(Bontron E84 manufactured by Orient Chemical Industries Co., Ltd. which is a compound 1 shown in Table 1)

The kneaded mixture was then cooled by rolling. The cooled mixture was pulverized and classified to obtain a black powder having a volume average particle diameter of 7.5 μm. The black powder was mixed using a mixer with a particulate titania which had been subjected to a hydrophobic treatment (STT30A manufactured by Titan Kogyo K.K.) in a mixing ratio of 0.8% by weight. Thus a black toner of the present invention was obtained.

Yellow Toner

The following components were mixed and agitated with a flusher.

| | |
|---|---|
| Water | 600 |
| Pigment Yellow 17 hydrous cake (solid content of 50%) | 1200 |

The mixture was then mixed with 1200 parts of an epoxy polyol resin (Mn: 3750, Mw/Mn: 4.2 and Tg: 59° C.) and kneaded at 150° C. for 30 minutes. The kneaded mixture was mixed with 1000 parts of xylene and further kneaded for 1 hour. After the water and the xylene were removed from the mixture, the mixture was pulverized with a pulverizer and then kneaded twice with a three-roller mill to obtain a yellow toner master batch.

The following components were mixed with a mixer, and then melted and kneaded with a two-roller mill.

| | |
|---|---|
| Epoxy polyol resin (Mn: 3750, Mw/Mn: 4.2 and Tg: 59° C.) | 100 |
| Yellow toner master batch | 8 |
| Zinc salicylate derivative | 2 |

(Bontron E84 manufactured by Orient Chemical Industries Co., Ltd. which is a compound 1 shown in Table 1)

The kneaded mixture was then cooled by rolling. The cooled mixture was pulverized and classified to obtain a yellow powder having a volume average particle diameter of 7.5 μm. The yellow powder was mixed using a mixer with a particulate titania which had been treated to a hydrophobic treatment (STT30A manufactured by Titan Kogyo K.K.) in a mixing ratio of 0.8% by weight. Thus a yellow toner of the present invention was obtained.

Magenta Toner

The following components were mixed and agitated with a flusher.

| | |
|---|---|
| Water | 600 |
| Pigment Red 57 hydrous cake (solid content of 50%) | 1200 |

The mixture was then mixed with 1200 parts of an epoxy polyol resin (Mn: 3750, Mw/Mn: 4.2 and Tg: 59° C.) and kneaded at 150° C. for 30 minutes. The kneaded mixture was mixed with 1000 parts of xylene and further kneaded for 1 hour. After the water and the xylene were removed from the mixture, the mixture was pulverized with a pulverizer and then kneaded twice with a three-roller mill to obtain a magenta toner master batch.

The following components were mixed with a mixer, and then melted and kneaded with a two-roller mill.

| | |
|---|---|
| Epoxy polyol resin (Mn: 3750, Mw/Mn: 4.2 and Tg: 59° C.) | 100 |
| Magenta toner master batch | 8 |
| Zinc salicylate derivative | 2 |

(Bontron E84 manufactured by Orient Chemical Industries Co., Ltd. which is a compound 1 shown in Table 1)

The kneaded mixture was then cooled by rolling. The cooled mixture was pulverized and classified to obtain a magenta powder having a volume average particle diameter of 7.5 μm. The magenta powder was mixed using a mixer with a particulate titania which had been treated to a hydrophobic treatment (STT30A manufactured by Titan Kogyo K.K.) in a mixing ratio of 0.8% by weight. Thus a magenta toner of the present invention was obtained.

Cyan Toner

The following components were mixed and agitated with a flusher.

| | |
|---|---|
| Water | 600 |
| Pigment Blue 15.3 hydrous cake (solid content of 50%) | 1200 |

The mixture was then mixed with 1200 parts of an epoxy polyol resin (Mn: 3750, Mw/Mn: 4.2 and Tg: 59° C.) and kneaded at 150° C. for 30 minutes. The kneaded mixture was mixed with 1000 parts of xylene and further kneaded for 1 hour. After the water and the xylene were removed from the mixture, the mixture was pulverized with a pulverizer and then kneaded twice with a three-roller mill to obtain a cyan toner master batch.

The following components were mixed with a mixer, and then melted and kneaded with a two-roller mill.

| | |
|---|---|
| Epoxy polyol resin (Mn: 3750, Mw/Mn: 4.2 and Tg: 59° C.) | 100 |
| Cyan toner master batch | 5 |
| Zinc salicylate derivative | 2 |

(Bontron E84 manufactured by Orient Chemical Industries Co., Ltd. which is a compound 1 shown in Table 1)

The kneaded mixture was then cooled by rolling. The cooled mixture was pulverized and classified to obtain a cyan powder having a volume average particle diameter of 7.5 $\mu$m. The cyan powder was mixed using a mixer with a particulate titania which had been treated to a hydrophobic treatment (STT30A manufactured by Titan Kogyo K.K.) in a mixing ratio of 0.8% by weight. Thus a cyan toner of the present invention was obtained.

Toner Manufacturing Example 2

The procedures for preparation of the black, yellow, magenta and cyan toners in Toner Manufacturing Example 1 were repeated to obtain a black, yellow, magenta and cyan toners of the present invention except that the particulate hydrophobic titania was replaced with a mixture of the particulate hydrophobic titania (STT-30A, manufactured by Titan Kogyo K.K.) whose mixing ratio to each color powder was 0.4% by weight and a particulate silica which was also subjected to a hydrophobic treatment (H-2000, manufactured by Hoechst AG) and whose mixing ratio to each color powder was 0.6% by weight.

Toner Manufacturing Example 3

The procedures for preparation of the black, yellow, magenta and cyan toners in Toner Manufacturing Example 2 were repeated to obtain a black, yellow, magenta and cyan toners of the present invention except that the zinc salicylate derivative was replaced with a compound 40 shown in Table 1.

Toner Manufacturing Example 4

The procedures for preparation of the black, yellow, magenta and cyan toners in Toner Manufacturing Example 1 were repeated to obtain a black, yellow, magenta and cyan toners of the present invention except that the particulate hydrophobic titania was replaced with the particulate hydrophobic titania (STT-30A, manufactured by Titan Kogyo K.K.) whose mixing ratio to each color powder was 0.7% by weight and a particulate silica which was subjected to a hydrophobic treatment (H-2000, manufactured by Hoechst AG) and whose mixing ratio to each color powder was 0.3% by weight.

Toner Manufacturing Example 5

The procedures for preparation of the black, yellow, magenta and cyan toners in Toner Manufacturing Example 1 were repeated to obtain a black, yellow, magenta and cyan toners of the present invention except that the particulate hydrophobic titania was replaced with the particulate hydrophobic titania (STT-30A, manufactured by Titan Kogyo K.K.) whose mixing ratio to each color powder was 1.0% by weight and a particulate silica which was subjected to a hydrophobic treatment (H-2000, manufactured by Hoechst AG) and whose mixing ratio to each color powder was 2.5% by weight.

Toner Manufacturing Example 6

The procedures for preparation of the black, yellow, magenta and cyan toners in Toner Manufacturing Example 1 were repeated to obtain a black, yellow, magenta and cyan toners of the present invention except that the mixing ratio of the particulate hydrophobic titania was changed to 0.05% by weight.

Toner Manufacturing Example 7

The procedures for preparation of the black, yellow, magenta and cyan toners in Toner Manufacturing Example 2 were repeated to obtain a black, yellow, magenta and cyan toners of the present invention except that the zinc salicylate derivative was replaced with a mixture of 1 part of the zinc salicylate derivative (Bontron E84, manufactured by Orient Chemical Industries Co., Ltd.) and 1 part of a fluorine-containing quaternary ammonium salt, Copy Charge VP NX434 manufactured by Hoechst AG.

Toner Manufacturing Example 8

The procedures for preparation of the black, yellow, magenta and cyan toners in Toner Manufacturing Example 2 were repeated to obtain a black, yellow, magenta and cyan toners of the present invention except that the particulate hydrophobic titania STT-30A was replaced with a particulate hydrophobic titania, MT150AFM manufactured by Tayca Corp.

Toner Manufacturing Example 9

The procedures for preparation of the black, yellow, magenta and cyan toners in Toner Manufacturing Example 4 were repeated to obtain a black, yellow, magenta and cyan toners of the present invention except that the particulate hydrophobic titania STT-30A was replaced with a particulate hydrophobic titania, MT150AFM manufactured by Tayca Corp.

Carrier Manufacturing Example 1

The following components were mixed for 30 minutes with a homo-mixer to prepare a carrier coating liquid.

| Formulation of carrier coating liquid | |
|---|---|
| Fluorine-contained acrylic resin (a compound 8 shown in Table 2) | 50 |
| A mixture of acetone and methyl ethyl ketone | 500 |

The thus prepared carrier coating liquid was coated on a surface of 1000 parts of a spherical ferrite carrier having an average particle diameter of 50 μm using a fluidized bed type coating apparatus to obtain a resin coated carrier A.

Carrier Manufacturing Example 2

The following components were mixed for 30 minutes with a homo-mixer to prepare a carrier coating liquid.

| Formulation of carrier coating liquid | |
|---|---|
| Vinylidene fluoride/tetrafluoroethylene copolymer (mole ratio of 60:40) | 20 |
| Fluorine-containing acrylic resin (a compound 14 shown in Table 2) | 30 |
| A mixture of acetone and methyl ethyl ketone | 500 |

The thus prepared carrier coating liquid was coated on a surface of 1000 parts of a spherical ferrite carrier having an average particle diameter of 60 μm using a fluidized bed type coating apparatus to obtain a resin coated carrier B.

Carrier Manufacturing Example 3

The following components were mixed for 30 minutes with a homo-mixer to prepare a carrier coating liquid.

| Formulation of carrier coating liquid | |
|---|---|
| Silicone resin solution (SR411 manufactured by Dow Corning-Toray Silicone Co., Ltd.) | 100 |
| Toluene | 100 |

The thus prepared carrier coating liquid was coated on a surface of 1000 parts of a spherical ferrite carrier having an average particle diameter of 50 μm using a fluidized bed type coating apparatus to obtain a resin coated carrier C.

Carrier manufacturing Example 4

The following components were mixed for 30 minutes with a homo-mixer to prepare a carrier coating liquid.

| Formulation of carrier coating liquid | |
|---|---|
| Silicone resin solution (KR50 manufactured by Shin-Etsu Chemical Co., Ltd.) | 100 |
| Silane coupling agent having an amino group (γ-(2-aminoethyl)aminopropyltrimethoxy silane) | 1 |
| Toluene | 100 |

The thus prepared carrier coating liquid was coated on a surface of 1000 parts of a spherical ferrite carrier having an average particle diameter of 60 μm using a fluidized bed type coating apparatus to obtain a resin coated carrier D.

Example 1

Four hundred (400) parts of resin coated carrier D and 16 parts of each of the four color toners obtained in Toner Manufacturing Example 1 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities, although lines of character images thereof were relatively wide compared to those of an original image but which were still acceptable for the present invention. In addition, an image formed on an OHP (over head projection) sheet had good transparency. The charging quantities of the four color toners after the running test were −17 to −19 μC/g which were relatively low compared to those of the toners before the running test but which were still acceptable for the present invention. Slight toner scattering was observed around the developing unit in the color copier but it was on an acceptable level. When the color copier including the color developers used for the running test was allowed to settle in environments of 30° C. 80% RH and 10° C. 15% RH and then color images were reproduced in each environment, there was no abnormal image in the reproduced color images.

Example 2

Four hundred (400) parts of resin coated carrier D and 16 parts of each of the four color toners obtained in Toner Manufacturing Example 2 were contained in respective ball mills and then mixed for 30 minutes to obtain four color developers. Initial charging quantities of the color toners in the color developers were from −24 to −26 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities. In addition, an image formed on an OHP (over head projection) sheet had good transparency. The charging quantities of the four color toners after the running test were −24 to −27 μC/g which were substantially the same as those of the toners before the running test. Toner scattering was hardly observed around the developing unit in the color copier. When the color copier including the color developers used for the running test was allowed to settle in environments of 30° C. 80% RH and 10° C. 15% RH and then color images were reproduced in each environment, there was no abnormal image in the reproduced color images.

Example 3

Four hundred (400) parts of resin coated carrier A and 16 parts of each of the four color toners obtained in Toner Manufacturing Example 2 were contained in respective ball mills and then mixed for 30 minutes to obtain four color developers. Initial charging quantities of the color toners in the color developers were from −24 to −26 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities, although the images had slight unevenness In addition, an image formed on an OHP (over head projection) sheet had good transparency. The charging quantities of the four color toners after the running test were stable, although they slightly shifted to a range of from −29 to −31 μC/g. Toner scattering was hardly observed around the developing unit in the color copier. When the color copier including the color developers used for the running test was allowed to settle in environments of30° C. 80% RH and 10° C. 15% RH and then color images were reproduced in each environment, there was no abnormal image in the reproduced color images.

Example 4

Four hundred (400) parts of resin coated carrier B and 16 parts of each of the four color toners obtained in Toner Manufacturing Example 2 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities. In addition, an image formed on an OHP (over head projection) sheet had good transparency.

The charging quantities of the four color toners after the running test were stable, although they slightly shifted to a range of from −25 to −27 μC/g. Toner scattering was hardly observed around the developing unit in the color copier. When the color copier including the color developers used for the running test was allowed to settle in environments of 30° C. 80% RH and 10° C. 15% RH and then color images were reproduced in each environment, there was no abnormal image in the reproduced color images.

Example 5

Four hundred (400) parts of resin coated carrier C and 16 parts of each of the four color toners obtained in Toner Manufacturing Example 2 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities, although the images had slight unevenness. In addition, an image formed on an OHP (over head projection) sheet had good transparency. The charging quantities of the four color toners after the running test were stable, although they slightly shifted to a range of from −27 to −29 μC/g. Toner scattering was hardly observed around the developing unit in the color copier. When the color copier including the color developers used for the running test was allowed to settle in environments of 30° C. 80% RH and 10° C. 15% RH and then color images were reproduced in each environment, there was no abnormal image in the reproduced color images.

Example 6

Four hundred (400) parts of resin coated carrier D and 16 parts of each of the four color toners obtained in Toner Manufacturing Example 3 were contained in respective ball mills and then mixed for 30 minutes to obtain four color developers. Initial charging quantities of the color toners in the color developers were from −20 to −22 μC/g. These color developers were installed in an electrophotographic color copier PRETER 550 manufactured by Ricoh Co., Ltd. and subjected to a running test in which sixty thousand (60,000) color images were continuously reproduced. All the obtained color images kept to have good image qualities, although lines of character images thereof were relatively wide compared to those of an original image but which were still acceptable for the present invention. In addition, an image formed on an OHP (over head projection) sheet had good transparency. The charging quantities of the four color toners after the running test were −16 to −18 μC/g which were relatively low compared to those of the toners before the running test but which were still acceptable for the present invention. Slight toner scattering was observed around the developing unit in the color copier but it was on an acceptable level. When the color copier including the color developers used for the running test was allowed to settle in environments of 30° C. 80% RH and 10° C. 15% RH and then color images were reproduced in each environment, there was no abnormal image in the reproduced color images.

Example 7

Four hundred (400) parts of resin coated carrier D and 16 parts of each of the four color toners obtained in Toner Manufacturing Example 4 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities, although image densities of thereof were slightly decreased. In addition, an image formed on an OHP (over head projection) sheet had good transparency. The charging quantities of the four color toners after the running test were stable, although they slightly shifted to a range of from −30 to −33 μC/g. Slight toner scattering was observed around the developing unit in the color copier but it was on an acceptable level. When the color copier including the color developers used for the running test was allowed to settle in environments of 30° C. 80% RH and 10° C. 15% RH and then color images were reproduced in each environment, there was no abnormal image in the reproduced color images although image densities of solid images increased in the environment of 30° C. 80% RH.

Example 8

Four hundred (400) parts of resin coated carrier D and 16 parts of each of the four color toners obtained in Toner Manufacturing Example 5 were contained in respective ball mills and then mixed for 30 minutes to obtain four color developers. Initial charging quantities of the color toners in the color developers were from −25 to −27 μC/g. These color developers were installed in an electrophotographic color copier PRETER 550 manufactured by Ricoh Co., Ltd. and subjected to a running test in which sixty thousand (60,000) color images were continuously reproduced. The obtained color images had good image qualities until 40,000 images were reproduced, and then image densities thereof were slightly decreased but which were still acceptable for the present invention. In addition, an image formed on an OHP (over head projection) sheet had good transparency. The charging quantities of the four color toners after the running test shifted to a range of from −36 to −41 μC/g but were still acceptable for the present invention. Slight toner scattering was observed around the developing unit in the color copier but it was on an acceptable level. When the color copier including the color developers used for the running test was allowed to settle in environments of 30° C. 80% RH and 10° C. 15% RH and then color images were reproduced in each environment, there was no abnormal image in the reproduced color images although image densities of solid images reproduced in both environments were relatively low compared to those of initial images reproduced in the normal environment.

Example 9

Four hundred (400) parts of resin coated carrier D and 16 parts of each of the four color toners obtained in Toner Manufacturing Example 6 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. The image densities of the obtained color images often decreased. However, it was still acceptable for the present invention because the image densities were returned to the initial level when the running test was stopped for a while. In addition, an image formed on an OHP (over head projection) sheet had good transparency. The charging quantities of the four color toners after the running test were stable, although they slightly shifted to a range of from −21 to −33 μC/g. Toner scattering was observed around the developing unit in the color copier but it was on an acceptable level. When the color copier including the color developers used for the running test was allowed to settle in environments of 30° C. 80% RH and 10° C. 15% RH and then color images were reproduced in each environment, there was no abnormal image in the reproduced color images although image densities of solid images reproduced in the environment of 30° C. 80% RH were relatively high compared to those of initial images reproduced in the normal environment.

Example 10

Four hundred (400) parts of resin coated carrier D and 16 parts of each of the four color toners obtained in Toner Manufacturing Example 8 were contained in respective ball mills and then mixed for 30 minutes to obtain four color developers. Initial charging quantities of the color toners in the color developers were from −25 to −27 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities. In addition, an image formed on an OHP (over head projection) sheet had good transparency. The charging quantities of the four color toners after the running test were stable, although they slightly shifted to a range of from −26 to −30 μC/g. Toner scattering was hardly observed around the developing unit in the color copier. When the color copier including the color developers used for the running test was allowed to settle in environments of 30° C. 80% RH and 10° C. 15% RH and then color images were reproduced in each-environment, there was no abnormal image in the reproduce color images.

Example 11

Four hundred (400) parts of resin coated carrier D and 16 parts of each of the four color toners obtained in Toner Manufacturing Example 9 were contained in respective ball mills and then mixed for 30 minutes to obtain four color developers. Initial charging quantities of the color toners in the color developers were from −26 to −28 μC/g. These color developers were installed in an electrophotographic color copier PRETER 550 manufactured by Ricoh Co., Ltd. and subjected to a running test in which sixty thousand (60,000) color images were continuously reproduced. All the obtained color images had good image qualities. In addition, an image formed on an OHP (over head projection) sheet had good transparency. The charging quantities of the four color toners after the running test were stable, although they slightly shifted to a range of from −28 to −31 μC/g but which were still acceptable for the present invention. Toner scattering was hardly observed around the developing unit in the color copier. When the color copier including the color developers used for the running test was allowed to settle in environments of 30° C. 80% RH and 10° C. 15% RH and then images were reproduced in each environment, there was no abnormal image in the reproduce color images.

Comparative Example 1

Four hundred (400) parts of resin coated carrier D and 16 parts of each of the four color toners obtained in Toner Manufacturing Example 7 were contained in respective ball mills and then mixed for 30 minutes to obtain four color developers. Initial charging quantities of the color toners in the color developers were from −22 to −24 μC/g. These color developers were installed in an electrophotographic color copier PRETER 550 manufactured by Ricoh Co., Ltd. and subjected to a running test in which sixty thousand (60,000) color images were continuously reproduced. The image densities of the obtained color images increased after 30,000 images were reproduced and fouling were observed at the both sides of the reproduced images after 50,000 images were reproduced. In addition, an image formed on an OHP (over head projection) sheet had good transparency. The charging quantities of the four color toners after the running test decreased to a range of from −13 to −15 μC/g. Serious toner scattering was observed around the developing unit in the color copier. When the color copier including the color developers used for the running test was allowed to settle in environments of 30° C. 80% RH and 10° C. 15% RH and then color images were reproduced in each environment, there was no serious problem in the reproduced color images.

The results are shown in Table 3.

TABLE 3

| | Initial | After running test (60,000 images) | | | | |
|---|---|---|---|---|---|---|
| | Charge Quantity (μC/g) | Image quality | Change of Image quality | Charge Quantity (μC/g) | Toner scattering | Image quality (30° C. 80% 10° C. 15%) |
| Example 1 | −22—−24 | good | no | −17—19 | Slightly scattered | no problem |
| Example 2 | −24—−26 | good | no | −24—27 | no | no problem |
| Example 3 | −24—−26 | good | no | −29—31 | no | no problem |
| Example 4 | −22—−24 | good | no | −25—27 | no | no problem |
| Example 5 | −22—−24 | good | no | −27—29 | no | no problem |
| Example 6 | −20—−22 | good | no | −16—18 | Slightly scattered | no problem |
| Example 7 | −22—−24 | good | no | −30—33 | Slightly scattered | no problem |
| Example 8 | −25—−27 | good | Image density slightly decreases | −36—41 | Slightly scattered | no problem |
| Example 9 | −22—−24 | good | Image density slightly decreases | −21—33 | Toner scattered (accepta-ble level) | no problem |
| Example 10 | −25—−27 | good | no | −26—30 | no | no problem |
| Example 11 | −26—−28 | good | no | −28—31 | no | no problem |
| Compar-ative Example 1 | −22—−24 | good | Fouling occurs | −13—15 | Seriously scattered | no problem |

As can be understood from the detailed descriptions mentioned above and Table 1, the color developer of the present invention can produce color images having good image qualities even when used for a long time, and can produce good color images even when used under various environmental conditions.

This application is based on Japanese Patent Application No. 09-153135, filed on May 28, 1997, and Japanese Patent Application No. 10-158666, filed on May 25, 1998, with the title, "Dry Developer for Developing Electrostatic Latent Image", by inventors, Kuramoto, Aoki, Yashiro, Oyamaguchi, and Sugimoto, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A color developer, comprising:

a toner and a resin-coated carrier, wherein said toner comprises a hydrophobic particulate titania and a charge controlling agent;

wherein said charge controlling agent comprises an aromatic hydroxycarboxylic acid metal salt having the following formula (1):

(1)

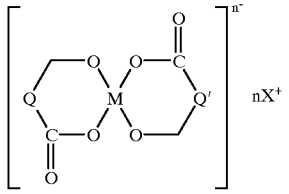

wherein each of Q and Q' independently represents a residual group of an aromatic hydroxycarboxylic acid optionally substituted with an ally group, an aralkyl group, or an alkyl group and an aralkyl group; X is a counter ion; and M is a metal.

2. The color developer as claimed in claim 1, wherein said Q and Q' each independently represents a residual group of an aromatic hydroxycarboxylic acid selected from the group consisting of salicylic acid, (C1–C12) allyl-substituted salicylic acid, 3,5-(C1–C12) dialkyl-substituted salicylic acid, 1-hydroxy-2-naphthoic acid, 2-hydroxy-3-naphthoic acid, 2-hydroxy-1-naphthoic acid, alkyl (C3–C12) 2-hydroxy-3-naphthoic acid, and 6-(α-methylbenzyl)-2-hydroxy-3-naphthoic acid, and mixtures thereof.

3. The color developer as claimed in claim 1, wherein said Q and Q' each independently represents a residual group of an aromatic hydroxycarboxylic acid selected from the group consisting of salicylic acid, (C1–C12) alkyl-substituted salicylic acid, and 3,5-(C1–C12) dialkyl-substituted salicylic acid, and mixtures thereof.

4. The color developer as claimed in claim 1, wherein said metal M is selected from the group consisting of Zn, Cr, Co, and Al, and mixtures thereof.

5. The color developer as claimed in claim 1, wherein said metal M is zinc.

6. The color developer as claimed in claim 1, wherein said resin-coated carrier comprises a carrier material selected from the group consisting of ferromagnetic metals, iron, cobalt, nickel, metal oxides, magnetite, hematite, ferrite, and glass beads, and mixtures thereof.

7. The color developer as claimed in claim 6, wherein said carrier material has an average particle size of about 10 to about 1000 $\mu$m.

8. The color developer as claimed in claim 1, wherein said resin-coated carrier is coated with a resin selected from the group consisting of polyfluorocarbon, polyvinyl chloride resins, polyvinylidene chloride resins, phenolic resins, polyvinyl acetal resins, silicone resins, and fluorine-containing resins, and mixtures thereof.

9. The color developer as claimed in claim 1, wherein said resin-coated carrier comprises a silicone resin.

10. The color developer as claimed in claim 1, wherein said resin-coated carrier comprises a fluorine-containing acrylic resin.

11. The color developer as claimed in claim 1, wherein the toner further comprises hydrophobic particles selected from the group consisting of hydrophobic particulate silica, hydrophobic particulate alumina, or a mixture thereof.

12. The color developer as claimed in claim 11, wherein a ratio of said hydrophobic particulate titania and said hydrophobic particles is from about 1/9 to about 6/4 by weight.

13. The color developer as claimed in claim 11, wherein said hydrophobic particulate titania and said hydrophobic particles are present in a total amount of about 0.1 to 2.0 parts by weight per 100 parts by weight of said toner.

14. The color developer as claimed in claim 11, wherein said hydrophobic particles are hydrophobic particulate silica.

15. The color developer as claimed in claim 1, wherein said toner further comprises a binder resin.

16. The color developer as claimed in claim 1, wherein said toner further comprises a coloring agent.

17. A method for preparing a color developer, comprising:

mixing a toner and a resin-coated carrier, wherein said toner comprises a hydrophobic particulate titania and a charge controlling agent;

wherein said charge controlling agent comprises an aromatic hydroxycarboxylic acid metal salt having the following formula (1):

(1)

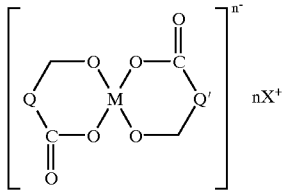

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

18. A toner, comprising:

a charge controlling agent which comprises an aromatic hydroxycarboxylic acid metal salt having the following formula (1):

(1)

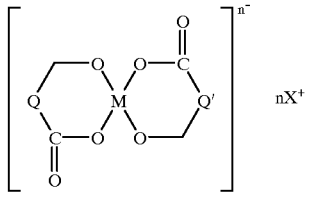

wherein each of Q and Q' independently represents a residual group of an aromatic hydroxycarboxylic acid optionally substituted with an alkyl group, an aralkyl group, or an alkyl group and an aralkyl group; X is a counter ion; and M is a metal.

* * * * *